US007655290B2

(12) United States Patent
Verrue et al.

(10) Patent No.: US 7,655,290 B2
(45) Date of Patent: Feb. 2, 2010

(54) CARPET TILES

(75) Inventors: Guy Verrue, Sint-Martens-Latem (BE); Raf Verdonck, Ghent (BE)

(73) Assignee: Berry Finance N.V. (BE)

( * ) Notice: Subject to any disclaimer, the term of this patent is extended or adjusted under 35 U.S.C. 154(b) by 110 days.

(21) Appl. No.: 10/585,836

(22) PCT Filed: Jan. 12, 2005

(86) PCT No.: PCT/EP2005/000233

§ 371 (c)(1),
(2), (4) Date: Jan. 22, 2007

(87) PCT Pub. No.: WO2005/067768

PCT Pub. Date: Jul. 28, 2005

(65) Prior Publication Data

US 2007/0184230 A1 Aug. 9, 2007

(30) Foreign Application Priority Data

Jan. 13, 2004 (EP) ..... 04000517

(51) Int. Cl.
*B32B 3/06* (2006.01)

(52) U.S. Cl. ..... 428/60; 428/62

(58) Field of Classification Search ..... 428/60, 428/62

See application file for complete search history.

(56) References Cited

U.S. PATENT DOCUMENTS

| | | | | |
|---|---|---|---|---|
| 3,694,983 | A | 10/1972 | Couquet | |
| 4,766,022 | A * | 8/1988 | Tone | 428/95 |
| 5,616,389 | A | 4/1997 | Blatz | |
| 6,244,802 | B1 * | 6/2001 | Stanesic et al. | 410/94 |
| 6,841,216 | B2 * | 1/2005 | Daniel et al. | 428/48 |

FOREIGN PATENT DOCUMENTS

| | | | |
|---|---|---|---|
| AU | 40926/72 | A1 | 4/1972 |
| CH | 669492 | A3 | 3/1989 |
| CN | 2143644 | Y | 10/1993 |
| DE | 20203782 | U1 | 8/2003 |
| EP | 1362947 | A2 | 5/2003 |
| GB | 1025852 | | 4/1966 |
| GB | 1213875 | | 11/1970 |
| GB | 1213875 | A1 | 11/1970 |

* cited by examiner

*Primary Examiner*—Alexander Thomas
(74) *Attorney, Agent, or Firm*—David I. Roche; Baker & McKenzie LLP

(57) ABSTRACT

To provide carpet tiles that can be installed more easily and quickly the inventive carpet tiles (1) comprise: a support plate (2); a carpet material (3) on said support plate 2; a first mechanical locking element (4) extending along a first joint edge (8*a*) of said carpet tile (1); and a second complementary mechanical locking element (5) extending along a second joint edge (8*b*) of said carpet tile (1).

25 Claims, 10 Drawing Sheets

1b
3
2
12
13'
5'
11
4
10''
8b
8a
10'
9
11
3
2
1a 3
2
9
3
2
1a

5'
10''
8a
9
2
3
11
8b
1a 1a
1b
2
3
4
5
8a
8b
10
11
12
13
24
A
B

CARPET TILES

The invention refers to carpet tiles.

Carpet tiles are well known in the art and are widely applied as flooring. Conventional carpet tiles include a carpet-material that is provided on a flexible backing made of, e.g., bitumen or polyvinyl chloride (PVC). With respect to these backing systems, however, there are several inherently negative attributes due to their feet stocks or their ability to be recycled. Particularly regarding PVC there are severe health and environmental concerns. While installing the tiles an accurate preparation of the underfloor is necessary. The subfloor must be level, clean, dry and homogeneous. The carpet tiles are then glued to the underfloor. The prior art carpet tiles and installation technique bring along several disadvantages. Once the carpet tiles are fixated to the underfloor, they are no longer removable. Due to shrinkage and dilatation gaps between the tiles may appear. A combination of several flooring materials is only possible with the help of a special profile that separates the different materials.

In view of the foregoing, it is the object of the present invention to provide carpet tiles that can be installed more easily and quickly without any chance of dilatation gaps, that can also be easily removed or replaced, that can be recycled and that allow an easy combination of several flooring materials without special profiles.

This object is met by a carpet tile comprising a support plate, a carpet material on said support plate, a first mechanical locking element extending along a first joint edge of said carpet tile, and a second complementary mechanical locking element extending along a second joint edge of said carpet tile.

According to the present invention, the first mechanical locking element of a first carpet tile is adapted to engage with a second complementary locking element of a second carpet tile, so that the joint edges of two juxtaposed carpet tiles can be connected. According to the present invention a less accurate preparation of the underfloor is needed, because the carpet tiles are floating on the underfloor. Since the different carpet tiles are connected by the respective locking elements, shrinkage and dilatation are taken by the whole floor and the appearance of gaps between the tiles is avoided. The locking element can be conceived in most of the cases in a way that the tile can be easily removed and replaced. No glue or adhesive material is necessary—although possible—which again leads to a clean, easy and odorless installation of the tiles. Moreover, a combination of several flooring materials is possible in an easy and clean way without the need for special profiles to separate the different materials. Nontoxic and recyclable materials can be used for the support plate.

Preferably, the first and second mechanical locking elements are provided on opposing joint edges.

As most of the carpet tiles, the carpet tile may have a square or right angle configuration and has therefore four joint edges. It is possible that the locking elements are provided on two opposing joint edges only, wherein the third and fourth joint edge simply abut again to each other.

According to a preferred embodiment, however, the carpet tile further includes a third locking element extending along a third joint edge and a complementary fourth locking element extending along a fourth joint edge of said carpet tile. As a result, an even more stable connection may be provided.

The locking elements may extend either along the entire length of said respective joint edges or only along a part of said respective joint edges.

Preferably, the support plate is formed of HDF (high density fiber), MDF (median density fiber), or polymer material.

HDF and MDF boards are robust and noncrushable. The polymer material can be injection molded or an extruded material that is machined as done with the HDF and MDF boards.

Preferably, the carpet material is formed of either needle felt, tuft or woven material.

According to the present invention, the first and/or third locking element may be a male locking element, whereas the second and/or fourth locking element may be a female locking element. The male locking element may include a lateral projecting tongue and said female locking element may include a lateral open groove. Such locking elements may be manufactured easily and may be constructed such that they horizontally and/or vertically lock the respective joint edges of two adjacent carpet tiles.

It is preferable that the first and second locking elements are formed to vertically lock the respective joint edges of the two carpet tiles, or are formed to vertically and horizontally lock the respective joint edges of two carpet tiles. Also the third and fourth locking elements may be formed to vertically lock the respective joint edges of the carpet tiles, or are formed to vertically and horizontally lock the respective joint edges of the two carpet tiles.

According to a preferred embodiment of the invention, the locking elements are integrally formed with the support plate. This means that the locking elements may be either integrally formed in one piece with said support plate or the locking element may at least be partly formed separately and may be mounted to the support plate at the factory. This enables to use, for example, a relatively stiff material for the support plate although the locking element requires more resilient materials, for example, as necessary for a locking element of the snapping type.

Alternatively, the locking element may also include a separate profile that is not premounted in the factory, but that is mechanically connectable to the support plate. Such a separate profile may serve as a locking extension that again constitutes a locking mechanism to be engagable with one of the mechanical locking elements of another carpet tile.

According to a preferred embodiment, for example, at least the first locking element includes a male locking mechanism and said separate profile which also extends along the first joint edge and which has two female locking mechanisms on both longitudinal sides; said male locking mechanism cooperates with one of said female locking mechanisms of said separate profile. Preferably said second or third locking element includes a complementary male locking mechanism that is engagable with the other of said female locking mechanisms of said separate profile. Alternatively, it is also possible that the first locking element includes a female locking mechanism and said separate profile extending along the first joint edge and having two male locking mechanisms on both longitudinal sides; said female locking mechanism cooperates with one of said male locking mechanisms of the separate profile. Said second or third locking element may include a complementary female locking mechanism that is engagable with the other one of said male locking mechanisms of said separate profile.

The application of the separate profile allows to turn square tiles over an angle of 90° or 180° relatively to each other which can be used for carpet tiles to obtain a chess board effect, because the pile directions are different, e.g., perpendicular to each other.

Preferably, the separate profile is either an extruded profile or an injection molded connection part and can therefore be manufactured easily.

According to another embodiment of the present invention at least the first and second locking elements include a first female part extending along a first length of said respective joint edge and a second male part extending over a second length of said same joint edge. Since on each joint edge there is provided a male and female part it is possible to turn the carpet tile to 90° or 180° respectively, relatively to each other, which again can be used to obtain a chess board effect, because the pile directions are different, e.g., perpendicular to each other.

According to another embodiment of the present invention, the support plate includes a support frame that again is provided with the respective locking elements. According to this embodiment, the support plate may, e.g., click into a support frame which also allows to change the different pile directions to, e.g., achieve a chess board effect as explained above, by simply clicking the support plates in different directions into the support frame.

It is preferable if the carpet tile has a support plate that has a cell structure. The cell structure of the support plate reduces noise, gives less weight and equal strength, facilitates the cutting of the tiles and moreover the compounding can allow the use of recycled material. Finally, such support plates having a cell structure lead to an improved thermal isolation.

The carpet material may be either glued to said support plate coextruded or attached by mold injection. There might be an intermediate material between the support plate and the carpet material such as, e.g., latex.

The first and second locking elements and/or the third and fourth locking elements may be of the angling down type or the snapping type. If for example, the first and second locking elements are of the angling down type the second locking element is, e.g., angled into the first locking element, e.g., the projecting tongue is angled into the lateral open groove. The third and fourth locking elements could then be connectable in the same plane and could therefore be, e.g., of the snapping type, because once a side of a carpet tile has already been locked to another carpet tile along the first and second joint edges, it is no longer possible to angle, for example, the third locking element into the fourth locking element and, as a result, these third and fourth joint edges may be connected by snapping which may be carried out in one plane. Alternatively these joint edges are simply abutted to one another. When the first and second locking elements are of the angling down type the third and fourth locking element may also be of the drop-down type, wherein e.g., while the second locking element is angled down into the first locking element the third locking element is dropped into the fourth locking element such that the third and fourth locking elements are locked in horizontal direction.

It is also possible that all four locking elements are either of the angling type or snapping type.

The invention will now be described with the help of the following figures:

FIG. 1*a* shows a partial cross-section of two locked carpet tiles according to the present invention.

FIG. 1*b* shows the partial cross-section of the carpet tiles of FIG. 1*a* that are connected by angling one locking element into a complementary locking element.

FIG. 2*a* is a top view of a carpet tile according to an embodiment of the present invention.

FIG. 2*b* is a top view of a carpet tile according to another embodiment of the present invention.

FIG. 2*c* is a top view of a carpet tile according to still another embodiment of the present invention.

FIG. 2*d* shows a top view of a carpet tile having a frame according to the present invention.

FIG. 3*a* shows a partial cross-section of two carpet tiles including a separate profile while being connected according to the present invention.

FIG. 3*b* shows a partial cross-section of the two carpet tiles of FIG. 3*a* in the locked state.

FIG. 3*c* shows a cross-section of a carpet tile according to the present invention which is connectable with a separate profile.

FIG. 4*a* shows a partial cross-section of two carpet tiles having a separate frame while being connected according to the present invention.

FIG. 4*b* shows a partial cross-section of two carpet tiles of FIG. 4*a* in a locked state.

FIG. 5*a* shows two carpet tiles according to the present invention having a snap mechanism while being connected.

FIG. 5*b* shows a partial cross-section of the carpet tiles as shown in FIG. 5*a* in a locked state.

FIGS. 6*a* and 6*b* show partial cross-sections of two carpet tiles according to the present invention having a snap mechanism while being connected.

FIG. 6*c* shows the carpet tiles of FIGS. 6*a* and 6*b* in a connected state.

Figure 2A:
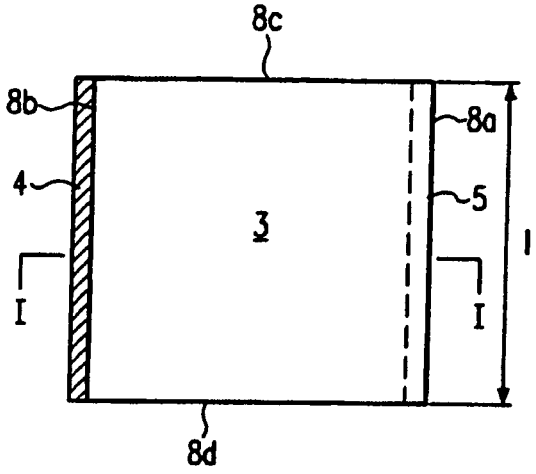
Figure 9:
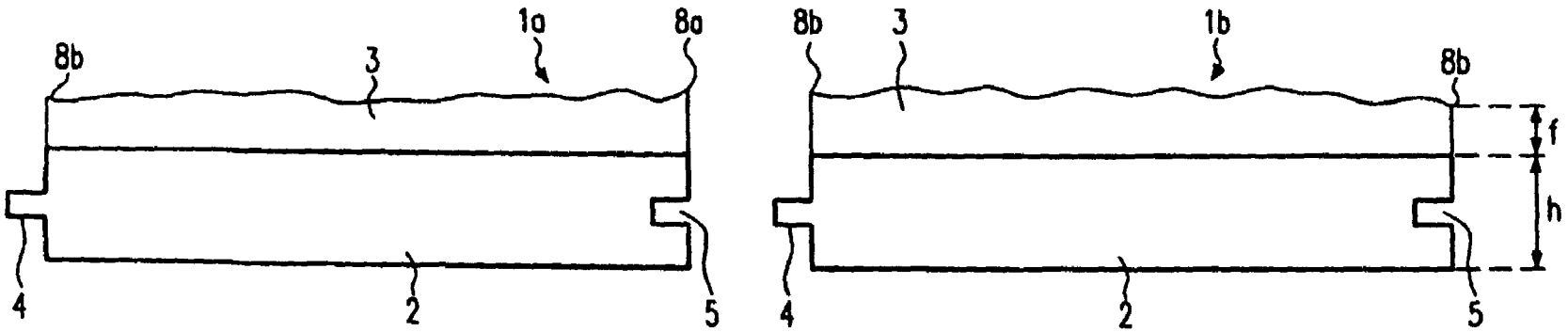
FIG. 9 shows cross-section of a carpet tile according to the present invention.
Figure 10:
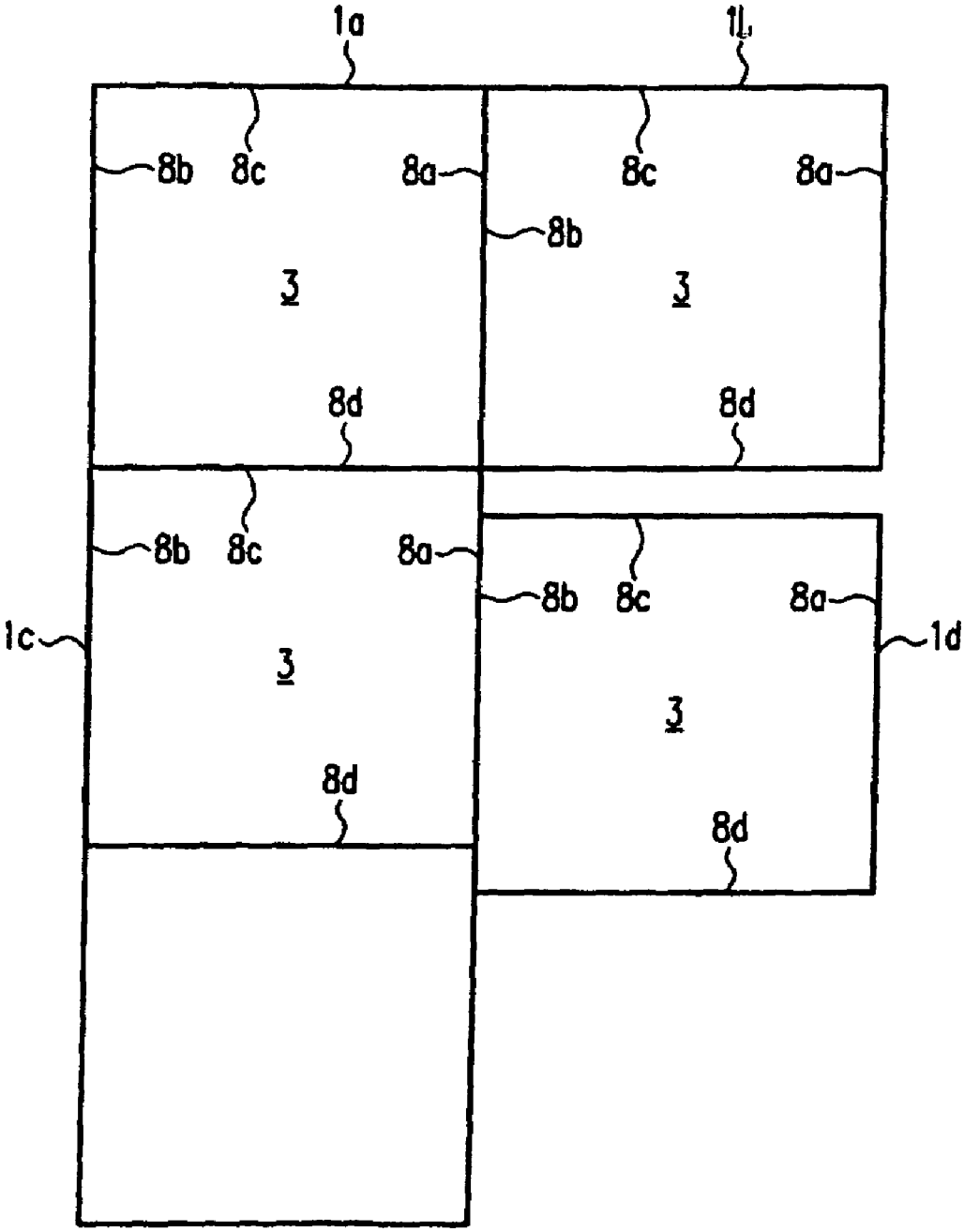
FIG. 10 shows a top view of several locked carpet tiles according to the present invention.

Referring now to FIGS. 2*a*, 9 and 10, the principle of the present invention is shown. As can be seen from FIG. 9, a carpet tile 1 according to the present invention includes a stiff support plate 2 and a carpet material 3 formed on said support plate 2. The support plate may have a rectangular shape preferably a square shape having a length l in a range of 40 to 60 cm. The height h of a carpet tile 2 lies in the range of 0.6 to 0.8 cm. The height of the carpet material f lies in the range of 2 to 8 mm. The carpet material is formed of needled felt, tufted or woven material. The support plate 2 is formed of either HDF or MDF boards, or polymer material. The polymer material can be injection molded or is formed as an extruded material that is then machined as done with the HDF and MDF boards into the respective shapes. The carpet material 3 can be glued to the support plate 2. The carpet material can also be coextruded or attached to the support plate 2 by inmold injection. Using the inmold injection technique, a 100% recyclable carpet tile can be produced, if the polymer material of the board is of the same type as the polymer material of the carpet. Such polymer materials are e.g. PP and PA. The carpet tile 1 according to the present invention has four joint edges 8*a*, 8*b*, 8*c*, 8*d* as can be seen from FIGS. 2, 9 and 10. Along the respective joint edges 8*a*, 9*b*, 8*c*, 8*d* the several carpet tiles 1*a*, 1*b*, 1*c*, 1*d* are interconnected to form a complete flooring.

To connect the various carpet tiles there are provided at least a first mechanical locking element 4 extending along a first joint edge 8*a* of said carpet tile 1, and a second complementary locking element 5 extending along a second opposing joint edge 8*b* of said carpet tile 1, as can be seen from FIGS. 2 and 9. The expression complementary locking element means that a first mechanical locking element of a first carpet tile 1*a* is adapted to cooperate with and to engage a second locking element 5 of a second carpet tile 1*b* such that the respective joint edges 8*a* and 8*b* are connected without gap therebetween. As can be seen in FIG. 9, the first mechanical locking element 4 is a male locking element, whereas the second mechanical locking element 5 is a female locking element cooperating with said male locking element 4. For ease of explanation in FIG. 9 a simple tongue 4 and groove 5 mechanism is shown. Such a mechanism locks the tiles in the vertical direction. In the horizontal direction, the carpet tiles are either held by each other or with the help of additional glue in case the carpet tiles should not be replaced or removed. Different locking types are described later on in combination with, e.g., FIGS. 1, 3, 5 and 6.

Figure 2B:
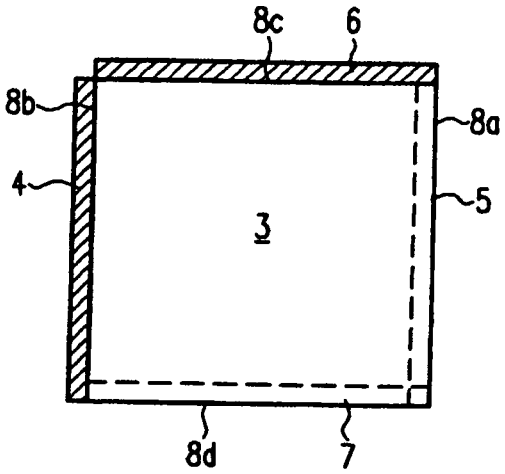

As can be seen from FIG. 2*a* there are only provided two mechanical locking elements 4,5 on opposing sides of the carpet tile 1. As discussed above, and as can also be seen from FIG. 10, the carpet tiles may be connected by the joint edges 8*a* and 8*b* by the locking mechanism 4 and 5, while the joint edges 8*c* and 8*d* are simply abutted to each other. It is, however, preferable, as can be seen from FIG. 2*b*, if edges 8*c* and 8*d* are also mechanically joined by respective third and fourth mechanical locking elements 6 and 7. As can be seen from FIG. 10, while joint edges 8*a* and 8*b* of the respective carpet tiles 1*c* and 1*d* have already been connected by cooperating the first and second locking elements 4 and 5, the carpet tile 1*d* is pushed towards carpet tile 1*b* in order to also engage the third and fourth mechanical locking elements 7 and 6 with each other. As a result, an even more stable connection of the carpet tiles is achieved. In FIGS. 2*a* and 2*b*, the respective locking element 4, 5, 6, and 7 extend along the entire length of said respective joint edges. Although not shown, the respective locking elements 4, 5, 6, and 7 may also extend only along a part of said respective joint edges 8*a*, 8*b*, 8*c*, 8*d*. The respective locking elements 4, 5, 6 and 7 have a longitudinal extension.

Figure 2C:
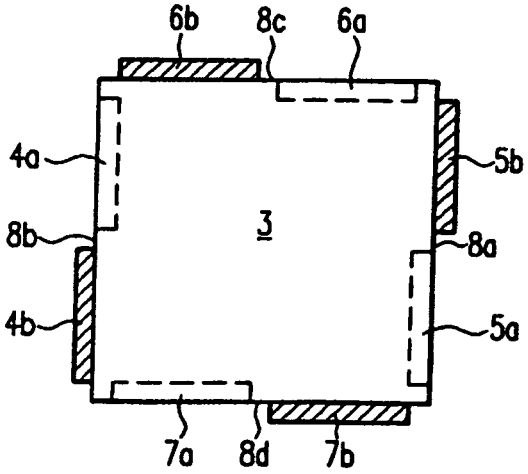

FIG. 2*c* shows another modification of the present invention. As can be seen from FIG. 2*c*, one locking element 4, 5, 6, 7 is constituted by two locking element parts 5*a*, 5*b*, 7*a*, 7*b*, 4*a*, 4*b*, 6*a*, 6*b*. A first female part 5*a*, 7*a*, 4*a*, 6*a* extends along a first length of said respective joint edge and a second male part extends over a second length of said same joint edge 8*a*, 8*b*, 8*c*, 8*d*. In FIG. 2*c* all locking elements are composed of at least two sub locking elements. The carpet tile as shown in FIG. 2*c* allows a 90° turning of the respective carpet tile with respect to each other, and moreover allows the carpet tiles to be staggered when laying.

In FIG. 2*c* all four joint edges have male and female locking parts, but it is also possible that only the first and second locking elements 4 and 5 are constituted by two sublocking parts 4*a*, 4*b*, 5*a*, 5*b* that enables the tiles to be staggered when laying.

Figure 1A:
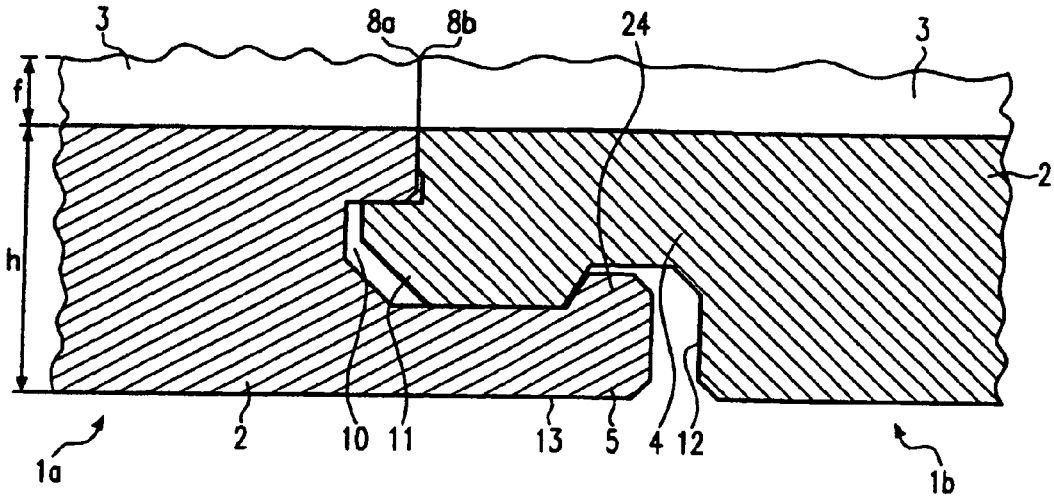
Figure 1B:
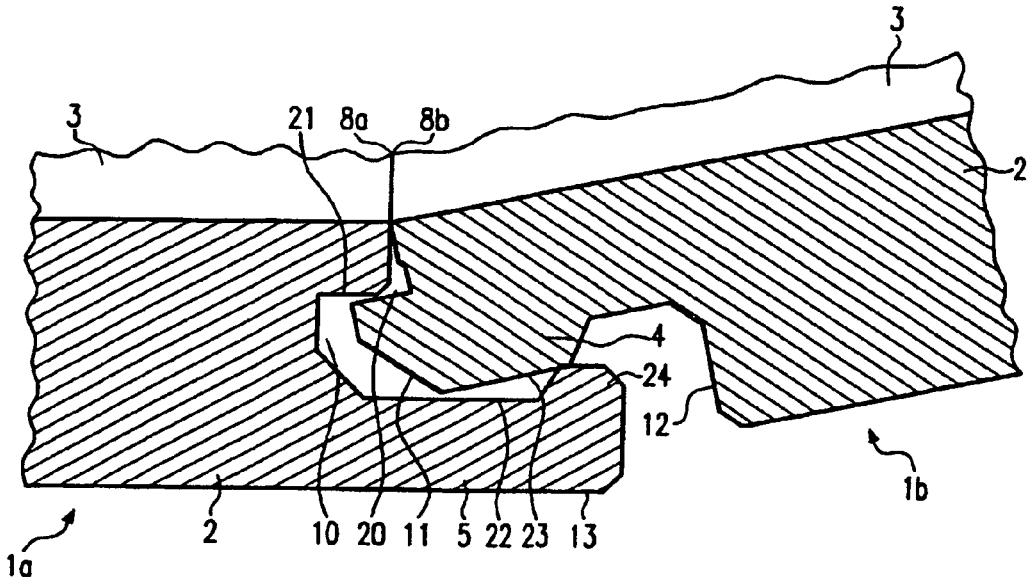

FIGS. 1*a* and 1*b* show partial cross-sections of two carpet tiles 1 according to the present invention that correspond to the above described carpet tiles 1 as discussed in combination with FIGS. 2*a*, 2*b*, 2*c*, 9 and 10, but which show a modified locking element. As the carpet tile 1 shown in FIG. 9, also the carpet tile 1 shown in FIGS. 1*a* and 1*b* has a locking element that is integrally formed in one piece with the support plate 2. The first mechanical locking element 4 is formed as a male locking element having a laterally projecting tongue 11, and the locking element 5 which, in this case, is the female locking element has a laterally open groove 10 which in the joined state receives tongue 11. The locking element 5 has horizontal abutment surfaces 21 and 22 and the locking element 4 has abutment surfaces 23 and 20. Finally, the locking element 5 has a projecting part 13 that has a locking extension 24 that extends in the vertical direction. Locking element 4 further includes a locking groove 12.

With the help of the locking elements shown in FIGS. 1 *a* and *b* two carpet tiles may be connected and locked in a vertical and horizontal direction without the application of glue. The vertical locking of the two joint edges 8*a*, 8*b* is realized by the upper and lower abutment surfaces 20, 21, 22 and 23 being essentially parallel with the principle plane of the carpet tile. The horizontal locking is realized by the locking extension 24 of the projecting part 13, which cooperates with the locking groove 12. As can be seen from FIG. 1*b* while connecting the two carpet tiles 1, the tongue 11 is angled into the groove 10 down to the subfloor. Although the projection 13 is shown to be integrally formed with the support plate 2, same can also be carried out as a separate part premounted, e.g., in the factory.

Figures 3A, 3B, 3C:
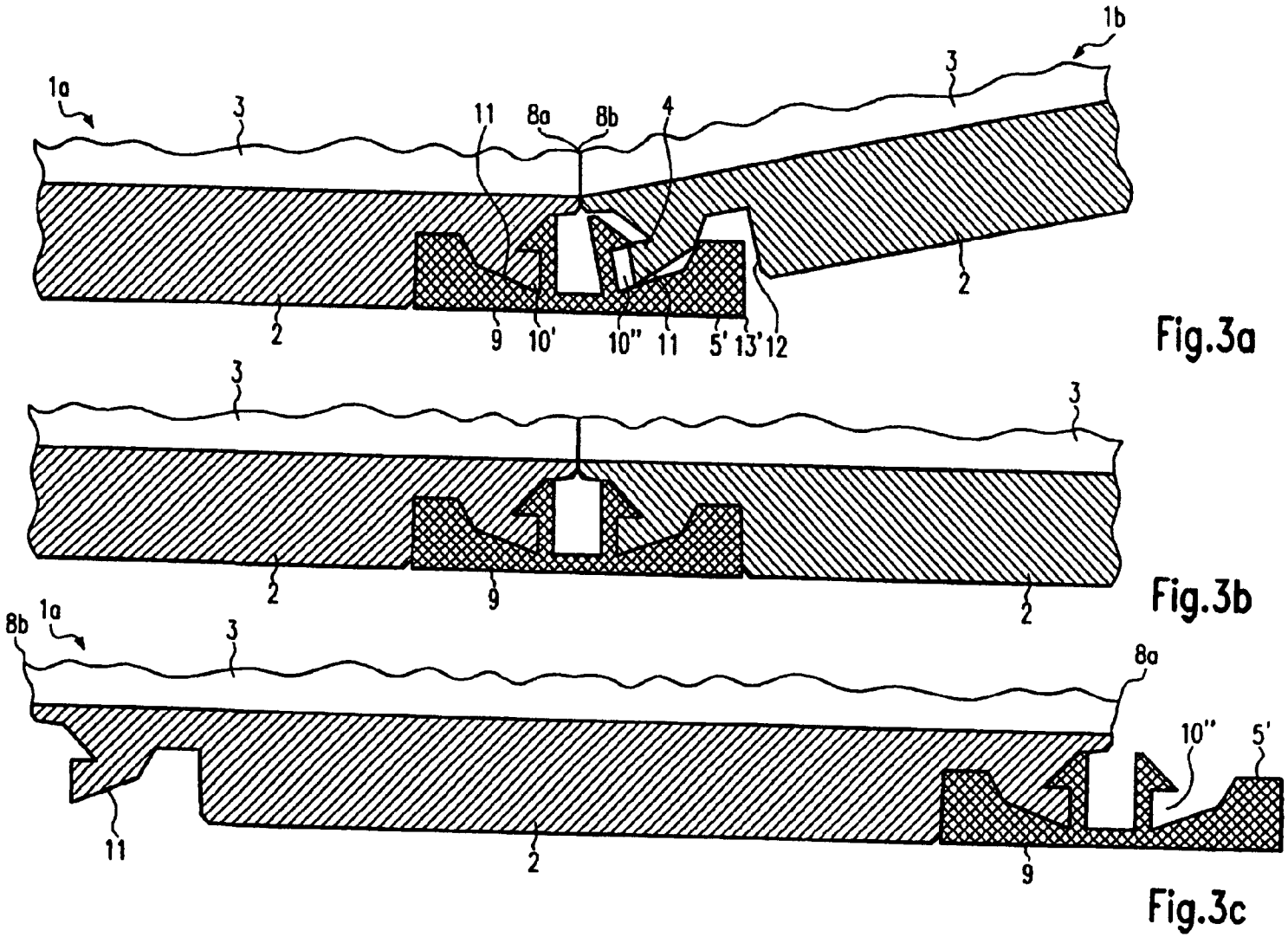

FIGS. 3*a* to 3*c* show another modification of the present invention. In the embodiment as shown in FIGS. 3*a* and 3*b*, the locking element 5' of a first carpet tile 1*a* includes a male part 11 and a separate profile 9. This separate profile 9 is either an extruded profile or an injection molded connection part which, in this case, serves as a locking extension. The male part 11, in this case tongue 11, engages with a female part, in this case groove 10' of the separate profile 9. The groove 10' also extends in the direction of the joint edge 8*a*. The separate profile 9 also includes another female locking part, namely groove 10" at the opposite side of the first groove 10'. This groove 10" is operable with tongue 11 of the locking element 4 of another carpet tile 1*b*. The locking element 4 of carpet tile 1*b* is connected with carpet tile 1*a* by angling the tongue 11 into the groove 10' of the separate profile 9 such that the joint edges 8*a* and 8*b* are connected, as can be seen in FIG. 3*b* which shows the two carpet tiles 1*a* and 1*b* in the locked state. While using such a separate profile 9, one can provide carpet tiles that may be connected with locking parts of the same type, in this case, male locking parts, which means tongues 11. This brings along the advantage that the carpet tile might be turned over an angle of 180° or 90° to each other to obtain a chess board effect, because the pile directions are different. Although in the embodiment as described in combination with FIG. 3, the carpet tile has male parts 11 on each side, namely tongues 11, and the separate profile 9 has female parts on its opposing sides, namely grooves 10', it is also possible to provide the carpet tile support 2 with two female parts on opposing sides and to provide the separate profile 9 with cooperating complementary male parts. It is possible that the first and second locking elements 4,5 have locking parts of the same type on opposing ends as shown in FIG. 3*c*. Even if not shown the third and fourth joint edges 8*c* and 8*d* also may have respective male or female parts. It is possible that those female or male parts may cooperate with the respective male or female part of the separate profile 9 such that, e.g., also joint edges 8*c* and 8*d* may be connected with joint edge 8*a* in a way as can be seen in FIGS. 3*a* and 3*b*, which enables the square tiles to be turned at a 90° angle relative to each other. In this embodiment, the male parts, which means tongues 11, do not laterally extend over a mating line of the respective joint edges 8*a*, 8*b*.

Figure 2D:
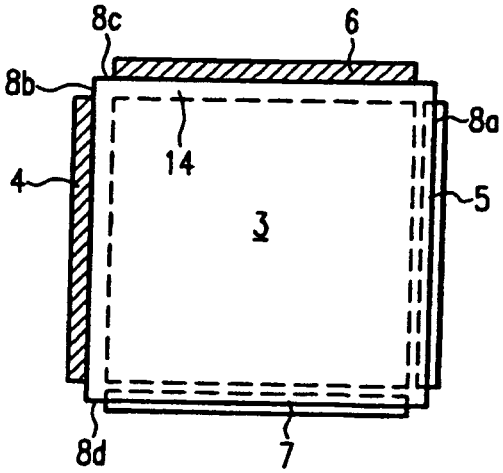
Figure 4A:
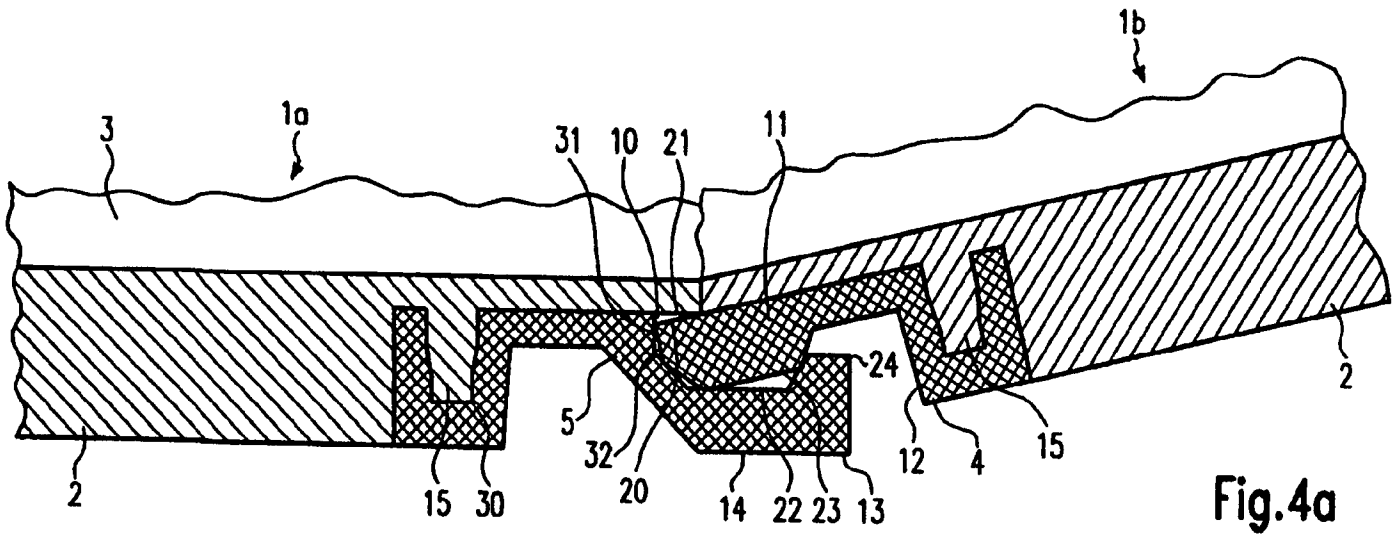
Figure 4B:
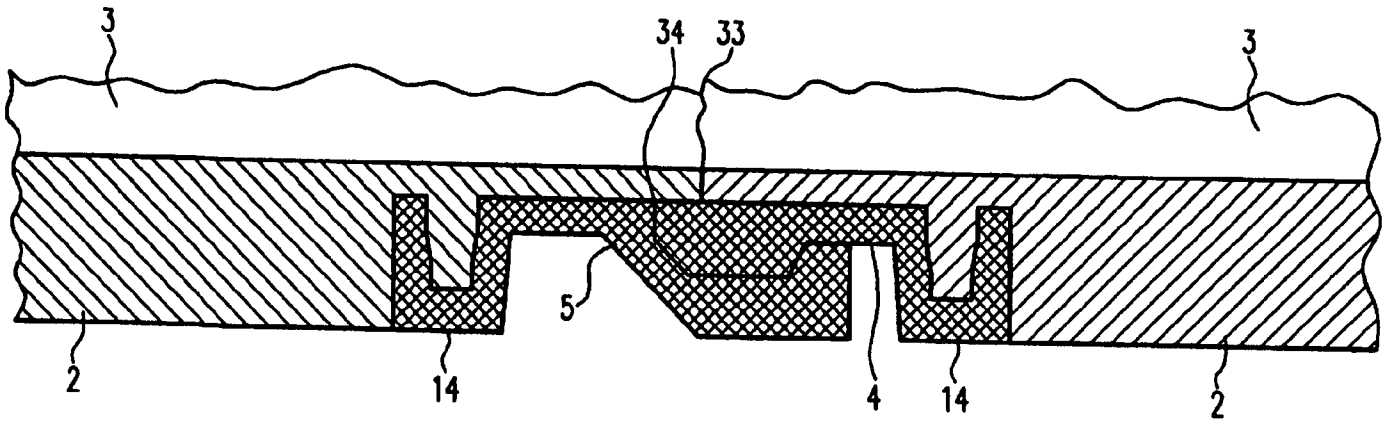

FIGS. 4*a*, 4*b* and 2*d* show still another embodiment of the present invention. In the embodiment as shown in FIGS. 4*a* and 4*b*, the support 2 is made of two components 2,14, namely the support plate 2 as such with the carpet material 3 thereon, wherein the support plate 2 clips into a frame 14 that again is provided with the respective locking elements 4, 5, 6, 7. As can be seen, e.g., from FIG. 4*a*, the support plate 2 includes a clicking projection 15, that may click into a respective groove 30 of the frame 14 wherein this click mechanism is formed such that the support plate 2 is horizontally and vertically fixed to the frame 14. As can be seen from FIG. 2*d*, the support frame 14 has substantially the same shape as the carpet tile 1, in this case, a square shape and is provided below the carpet material surface. As also described in combination with FIGS. 2*a* and 2*b* or 2*c* in combination with FIG. 10 for the previous embodiments the carpet tile may have either a first and a second locking element, e.g., on two opposing sides of the frame 14 or may have all in all four locking elements 4, 5, 6, and 7, one for each joint edge 8*a*, 8*b*, 8*c*, 8*d* of the carpet tile 1. As in the previous embodiments this embodiment also has a female locking element 5 which includes a groove 10 and the male locking element 4 which includes a projecting tongue 11, wherein for connecting the two tiles 1*a* and 1*b*, the tongue 11 angles into the groove 10. This embodiment realizes a vertical locking by the abutment surfaces 20, 21, 22 and 23. A horizontal locking is guaranteed by the projection 13 of the frame 14 which has a respective locking extension 24 which engages the respective groove 12 as well as by the basically horizontal abutment surfaces 31 and 32 of the respective female 5 and male 4 locking elements. In this embodiment, the longitudinal abutment line of the carpet material 3 is laterally displaced from the longitudinal abutment line 34 of the frame 14. With such a frame it is possible to arbitrarily to turn the carpet material 3 on the support plate 2 in the frame 14 such that an arbitrary pile direction is possible. The material of the frame is, for example, polypropylene (PP).

Figure 5A:
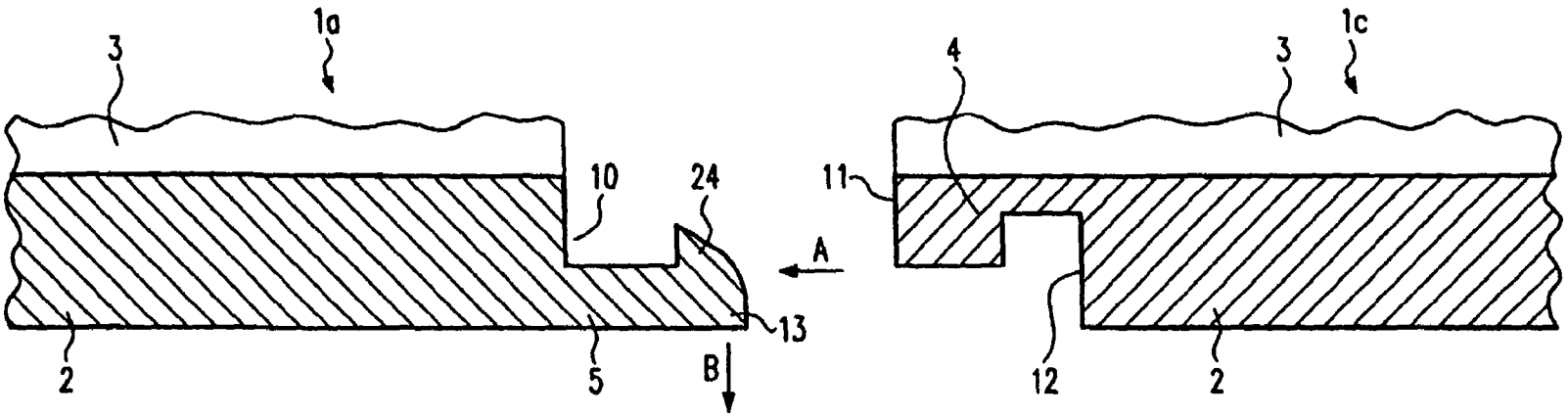
Figure 5B:
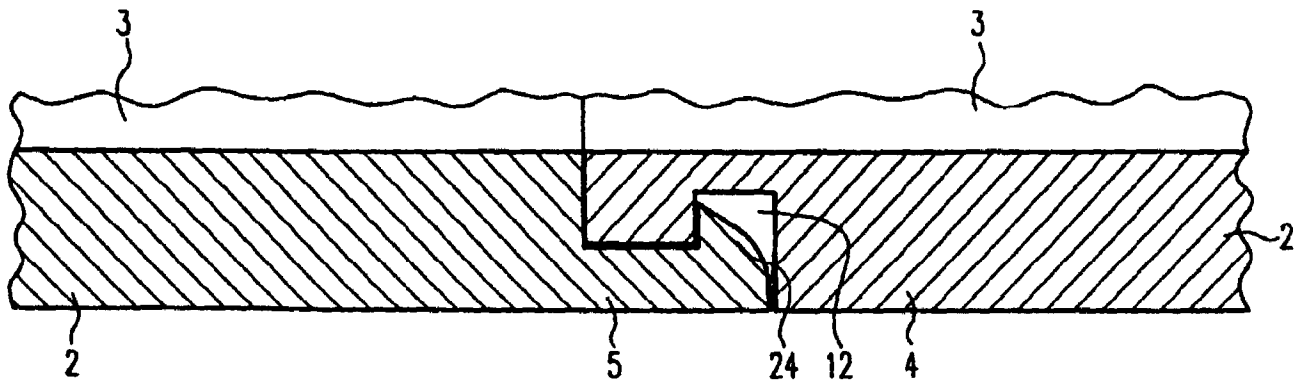

FIGS. 5*a* and 5*b* show still another modification of the locking elements which, in contrast to FIGS. 1, 3 and 4, show a locking element of the snapping type which only locks the two carpet tiles 1*a*, 1*c* in the horizontal direction. The female locking element 5 has a resilient projection 13 with a vertically extending locking extension 24, whereas the complementary male locking element 4 has a projecting tongue 11 and a locking groove 12. In contrast to the previous embodiment in this case, the locking elements 4,5 are not connected by angling the male locking element 4 down into the female locking element 5, but instead the two locking element 4, 5 may be connected within one plane wherein locking element 4 is pushed in the direction of the arrow A to locking element 5 wherein the projecting tongue 11 presses down the beveled surface of locking extension 24 such that the resilient projection 13 is pressed in the direction of arrow B. The lateral projecting tongue 11 snaps into the groove 10 and the locking extension 24 into locking groove 12. As can be seen in FIG. 5, the two locking elements 4, 5 are locked in the horizontal direction by the locking extension 24 provided in the locking groove 12.

Figures 6A, 6B, 6C:
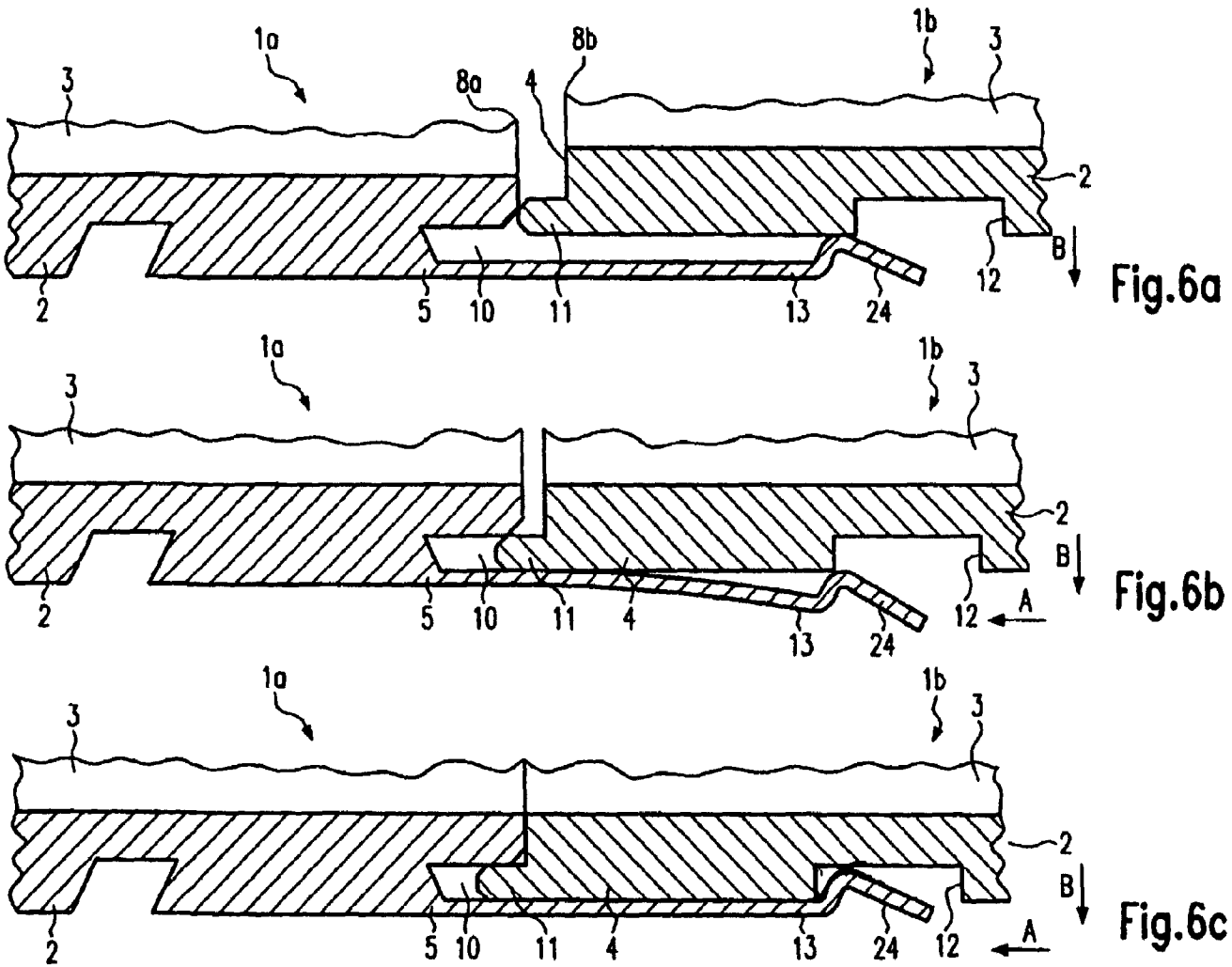

FIGS. 6*a* to 6*c* show still another locking mechanism which basically corresponds to the locking mechanism as discussed in combination with FIGS. 1*a* and 1*b* and which also locks the two carpet tiles 1*a* and 1*b* in the horizontal and vertical directions. The same reference numerals designate the same parts. The only difference between the embodiment as shown in FIG. 1 and the modification as shown in FIG. 6 is that the projection 13 is formed as a resilient projection also having a locking extension 24 which also extends in the vertical direction. While connecting carpet tiles 1*a* and 1*b*, the locking elements of the carpet tiles 4,5 must not be angled into one another, but instead the carpet tile 1*b* may first be pressed in the direction of the arrow B to deform the resilient projection 13 into direction B, such that the laterally projecting tongue 11 of locking element 4 can be pushed along the direction as indicated by arrow A into groove 10 in the same plane (FIG. 6*b*), the locking extension 24 then snaps into groove 12 and as can be seen from FIG. 6*c* which shows the locking elements 4,5 in a locked state, the two carpet tiles 1*a* and 1*b* are locked in the horizontal direction by the locking extension 24 and the groove 12 and also in the vertical direction by the abutment surfaces of the laterally extending tongue and the respective groove 10.

Referring now to FIG. 10, while laying the respective carpet tiles, e.g., laying carpet tile 1*d* there are the following possibilities.

The joint edges 8*a* and 8*b* of carpet tile 1*c* and 1*d* are first, e.g., connected by respective locking elements 4,5 that lock the two carpet tiles 1*c* and 1*d* in the horizontal as well as in the vertical direction either by angling down the first locking element 4 into the second locking element 5 with the help of the mechanism as, e.g., shown in FIGS. 1*a* and 1*b* or with the help of a locking mechanism as e.g., shown in FIG. 6, wherein the carpet tile 1*d* is first pressed in direction B to the subfloor and then pushed in direction A towards the adjacent carpet tile 1*c*. The carpet tile 1*d* may then be pushed in a direction such that the joint edges 8*c* and 8*d* of carpet tiles 1*d* and 1*b* either abut each other or are connected by respective locking elements 6 and 7. The joint edges 8*c* an 8*d* may be connected by snapping a third locking element into a fourth locking element as e.g., shown in FIG. 5*b* or 6. The joint edges 8*c* and 8*d* may also be connected by angling down a third locking element into a fourth locking element, thereto the carpet tile 1*c* has to be angled up also, since the carpet tile 1*d* is already vertically and horizontally locked along the joint edge 8*b*. Since the respective carpet tiles 1*d* and 1*b* are already locked in the vertical direction along joint edge 8*b*, it is sufficient if for the respective perpendicular joint edges 8*c* and 8*d* a locking mechanism is used that fixes the two elements only in the horizontal direction as shown, e.g., in FIGS. 5*a* and 5*b*.

Figure 7:
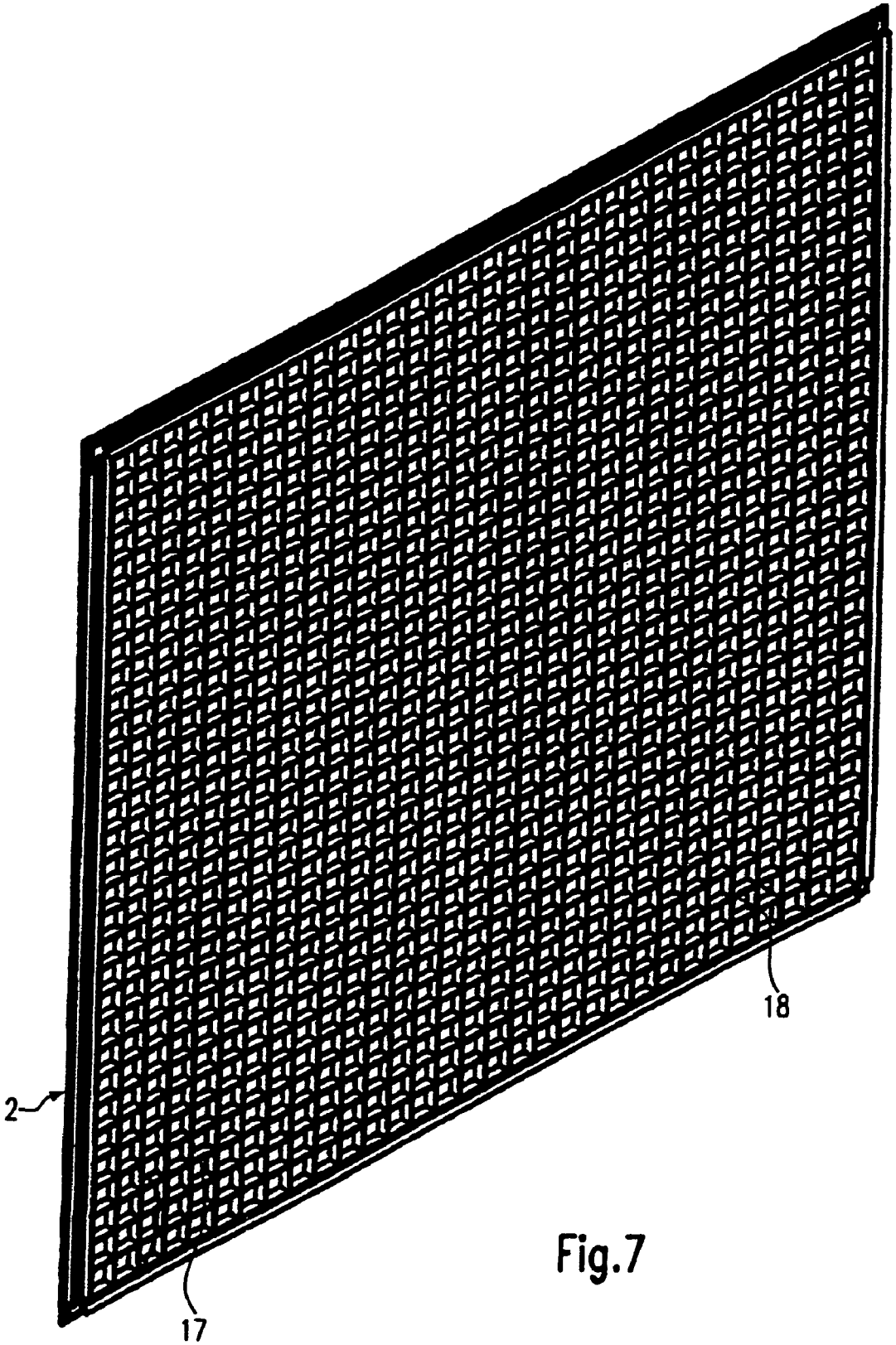
FIG. 7 shows a perspective view of the backside of a carpet tile having a cell structure according to the present invention.
Figure 8:
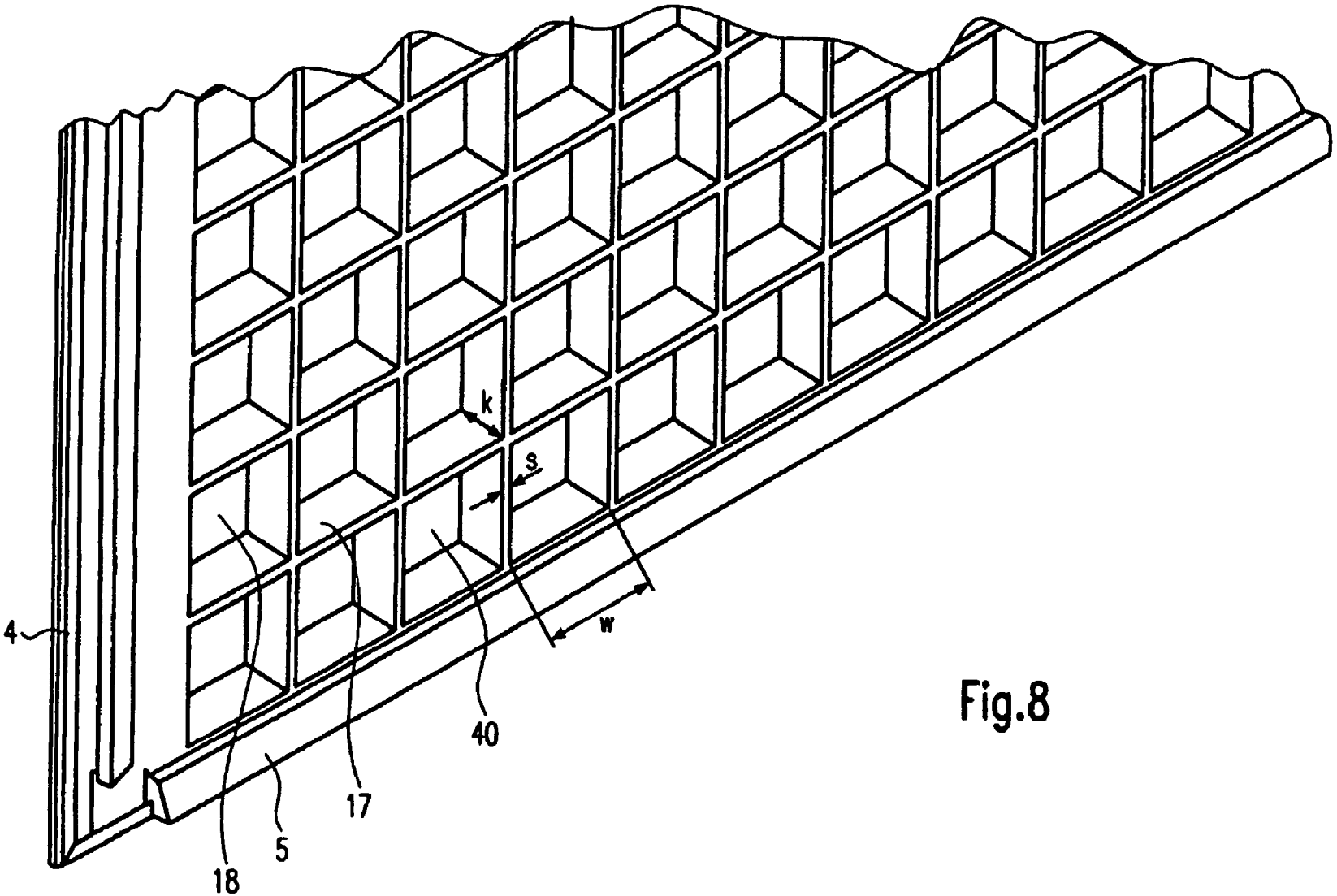
FIG. 8 shows an enlarged partial view of FIG. 7.

FIGS. 7 and 8 show the perspective view of a backside of a carpet tile having a support plate 2 with a cell structure. It is preferable if the support plate 2 does not have a compact structure, but instead is formed of several cells. The cells are formed by a variety of perpendicularly arranged webs 17 that form the respective hollow cells 18. In this case, the cells are square shaped and have a width w in the range of 10 to 20 mm. The thickness s of one web 17 lies in the range of 1 to 2 mm. The height k of one web lies in the range of 4 to 7 mm. Preferably the upper surface of the web frame is closed and there may be provided a plate 40 whereon the carpet material 3 is fixed. Of course the cells of the support plate 2 need not have a square shape but may also have a different shape such as a rhomb shape, round shape, etc., as long as hollow cells are formed by surrounding webs. Such a web structure brings along the advantage of reduced noise while walking on the carpet tile, gives less weight and equal strength, facilitates the cutting of the tiles. Also recycled material such as recycled polypropylene (PP) can be used for the cell structure as shown in FIGS. 7 and 8. The mass of such a support plate 2 lies in the range of 2000 to 4000 g/m$^2$.

According to the present invention as described above, carpet tiles can be connected in an easy manner without any chance of dilatation gaps and the tiles can also again be easily removed and replaced. Another advantage is the combination of several flooring materials in an easy clean way with no need for special profiles to separate the different materials. This means that a flooring system may be used that includes carpet tiles as discussed above together with flooring tiles that also have a support plate with respective locking elements that cooperate with the respective locking element of the inventive carpet tiles. The flooring tiles may have a different flooring material on the surface thereof, while, however, the carpet material and the flooring material of the flooring tile lay in one plane.

Using the production technique of inmold injection, a 100% recyclable carpet tile can be produced.

The invention claimed is:

1. A carpet tile comprising a support plate having a cell structure formed of a plurality of perpendicularly arranged webs that form hollow cells;

a carpet material on said support plate;

a first mechanical locking element extending along a first joint edge of said carpet tile;

a second complementary mechanical locking element extending along a second joint edge of said carpet tile;

an upper side of the hollow cells is closed by a plate on which the carpet material is fixed and the cells are only open to the bottom.

2. The carpet tile according to claim 1, wherein said first and second mechanical locking elements are provided on opposing joint edges.

3. The carpet tile according to claim 2, wherein said support plate is formed of either HDF, MDF or polymer material.

4. The carpet tile according to claim 3 wherein said first or third locking element is a male locking element, and said second or fourth locking element is a female locking element.

5. The carpet tile according to claim 4, wherein said male locking element includes a lateral projecting tongue and said female locking element includes a lateral open groove.

6. The carpet tile according to claim 5, wherein said first and second locking elements are formed to vertically lock the respective joint edges of two carpet tiles or are formed to vertically and horizontally lock the respective joint edges of two carpet tiles.

7. The carpet tile according to claim 1, wherein said carpet tile has four joint edges and further includes a third locking element extending along a third joint edge and a complementary fourth locking element extending along a fourth joint edge of said carpet tile.

8. The carpet tile according to claim 7, wherein the respective locking elements extend either along the entire length of said respective joint edges or along a part of said respective joint edges.

9. The carpet tile according to claim 7, wherein said carpet material is formed of either needled felt, tuft or woven material.

10. The carpet tile according to claim 7, wherein said third and fourth locking elements are formed to vertically lock the respective joint edges of two carpet tiles, or are formed to vertically and horizontally lock the respective joint edges of two carpet tiles.

11. The carpet tile according to claim 10, wherein said locking elements are integrally formed with said support plate.

12. The carpet tile according to claim 10, wherein at least one locking element includes a separate profile.

13. The carpet tile according to claim 12, wherein said separate profile is either an extruded profile or an injection molded connection part.

14. The carpet tile according to claim 13, wherein said first locking element includes a male part and said separate profile having a female part on each longitudinal side, respectively, said male part cooperates with one of said female parts of said separate profile.

15. The carpet tile according to claim 14, wherein said second or third locking element includes a complementary male part that is engagable with the other one of said female parts of said separate profile.

16. The carpet tile according to claim 12, wherein said first locking element includes a female part and said separate profile having a male part on each longitudinal side, respectively, said female locking part cooperates with one of said female parts of said separate profile.

17. The carpet tile according to claim 16, wherein said second or third locking element includes a complementary female part that is engagable with the other one of said male parts of said separate profile.

18. The carpet tile according to claim 17, wherein at least the first and second locking elements include a first female part extending along a first length of said respective joint edge and a second male part extending over a second length of said same joint edge.

19. The carpet tile according to claim 7, wherein said first and second locking elements are configured to either angling down or snap into engagement with adjacent carpet tiles.

20. The carpet tile according to claim 19, wherein said third and fourth locking elements are configured to either angling down or snap into engagement with adjacent carpet tiles.

21. The carpet tile according to claim 1, wherein said support plate includes a support frame that is provided with the respective locking elements.

22. The carpet tile according to claim 21, wherein said support plate has a cell structure.

23. The carpet tile according to claim 22, wherein said carpet material is glued to said support plate, coextruded or attached by mold injection.

24. The carpet tile according to claim 23, wherein an intermediate material is provided between the support plate and the carpet material.

25. The carpet tile according to claim 23, wherein all locking elements are connectable in the same plane.

* * * * *